US006357413B1

(12) United States Patent
Ito et al.

(10) Patent No.: US 6,357,413 B1
(45) Date of Patent: Mar. 19, 2002

(54) INTERNAL COMBUSTION ENGINE POWER UNIT

(75) Inventors: Katsuhiko Ito; Mitsuru Saito; Hideyuki Tawara, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,342

(22) Filed: Sep. 1, 2000

(30) Foreign Application Priority Data

Sep. 3, 1999 (JP) ..... 11-250062

(51) Int. Cl.[7] ..... F02B 75/32

(52) U.S. Cl. ..... 123/197.1; 123/196 R; 123/192.2

(58) Field of Search ..... 123/196 R, 197.1, 123/192.2; 74/732.1, 606 R

(56) References Cited

U.S. PATENT DOCUMENTS 4,834,219 A * 5/1989 Inagaki et al. ..... 184/6.5
4,875,390 A * 10/1989 Hayashi et al. ..... 74/731
5,038,634 A * 8/1991 Matsuto et al. ..... 74/730.1
5,060,477 A * 10/1991 Hayashi et al. ..... 60/488
5,078,105 A * 1/1992 Ito et al. ..... 123/195 R
5,085,053 A * 2/1992 Hayashi et al. ..... 60/488
5,152,361 A * 10/1992 Hasegawa et al. ..... 180/230
5,584,214 A * 12/1996 Hayashi et al. ..... 74/732.1
5,636,608 A * 6/1997 Shichinohe et al. ..... 123/197.1
5,992,355 A * 11/1999 Shichinohe et al. ..... 123/41.56
6,082,220 A * 7/2000 Kitagawa ..... 74/606 R

FOREIGN PATENT DOCUMENTS

JP 826929 B2 3/1996
JP 2696520 B2 9/1997
JP 335439 * 12/2000 ..... B62D/11/08

* cited by examiner

*Primary Examiner*—Willis R. Wolfe
*Assistant Examiner*—Hal Huynh
(74) *Attorney, Agent, or Firm*—Birch, Stewart, Kolasch & Birch

(57) ABSTRACT

A oil supply system supplies the same oil for lubricating an engine and for driving a hydrostatic infinitely variable transmission. The hydrostatic infinitely variable transmission is built into a crankcase of the engine, resulting in an overall compact configuration. A drive shaft of the hydrostatic infinitely variable transmission is provided parallel with a crankshaft of the engine. Axial centers of the drive shaft and crankshaft can be made hollow and serve as oilways. Further, an axial center of a counter shaft of the hydrostatic infinitely variable transmission can be made hollow and serve as an oilway. By the present oil supply system, engine oil is used in common as drive oil for the hydro-static infinitely variable transmission, and as oil supplied to parts of a cylinder head, a stepped transmission, and other various parts of the engine and transmission, thereby elimating the duplication of oil pumps and filters and reducing the maintanance associated with servicing independent oil systems.

12 Claims, 4 Drawing Sheets

INTERNAL COMBUSTION ENGINE POWER UNIT

BACKGROUND OF THE INVENTION

1. Field of the Invention

This invention relates to a power unit having an internal combustion engine and a transmission. More particularly, the present invention concerns the lubricating system and the relationship of the lubricating system between the internal combustion engine and the transmission.

2. Description of the Relevant Art

An engine is an assembly that derives power by converting combustion energy, obtained by combusting fuel, into mechanical energy. In the case of a reciprocating engine, the engine includes a crankshaft, a primary reduction output gear provided on the crankshaft, and a crankcase covering the crankshaft and the primary reduction output gear.

A hydrostatic infinitely variable transmission is an assembly where a fixed capacity swash plate-type hydraulic pump and a variable capacity hydraulic motor are located on the same axis, so that an infinitely variable transmission output can be obtained by varying the swash plate of the hydraulic motor on the output side. A hydrostatic infinitely variable transmission is well known, and examples are given in Japanese Patent Publication Hei. 8-26929 and Japanese Patent No. 2696520.

According to the background art, a case member defines a dedicated engine crank chamber and a dedicated transmission chamber. Separate dedicated oil is used as oil for driving and engine oil for engine lubrication. In other words, a vehicle having a hydrostatic infinitely variable transmissions has an engine section and a hydrostatic infinitely variable transmission section defined as separate chambers, each having separate oil supplies.

The background art suffers drawbacks. The volume or size of the power unit, which includes the internal combustion engine and the hydrostatic infinitely variable transmission is relatively large and bulky. Further, the engine oil and the hydrostatic infinitely variable transmission oil have to be managed separately by an owner or service person, and replication of parts occurs in operating the two systems separately.

SUMMARY OF THE INVENTION

The present invention has as an object to provide an internal combustion engine power unit which resolves one or more of the drawbacks associated with the background art.

In accordance with the present invention a hydrostatic infinitely variable transmission is built-into the engine crankcase. By integrally building the hydro-static infinitely variable transmission into the engine crankcase, a dedicated chamber for housing the hydro-static infinitely variable transmission can be elimated, and the internal combustion engine power unit can be made more compact, and oil can also be used in common.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 2:
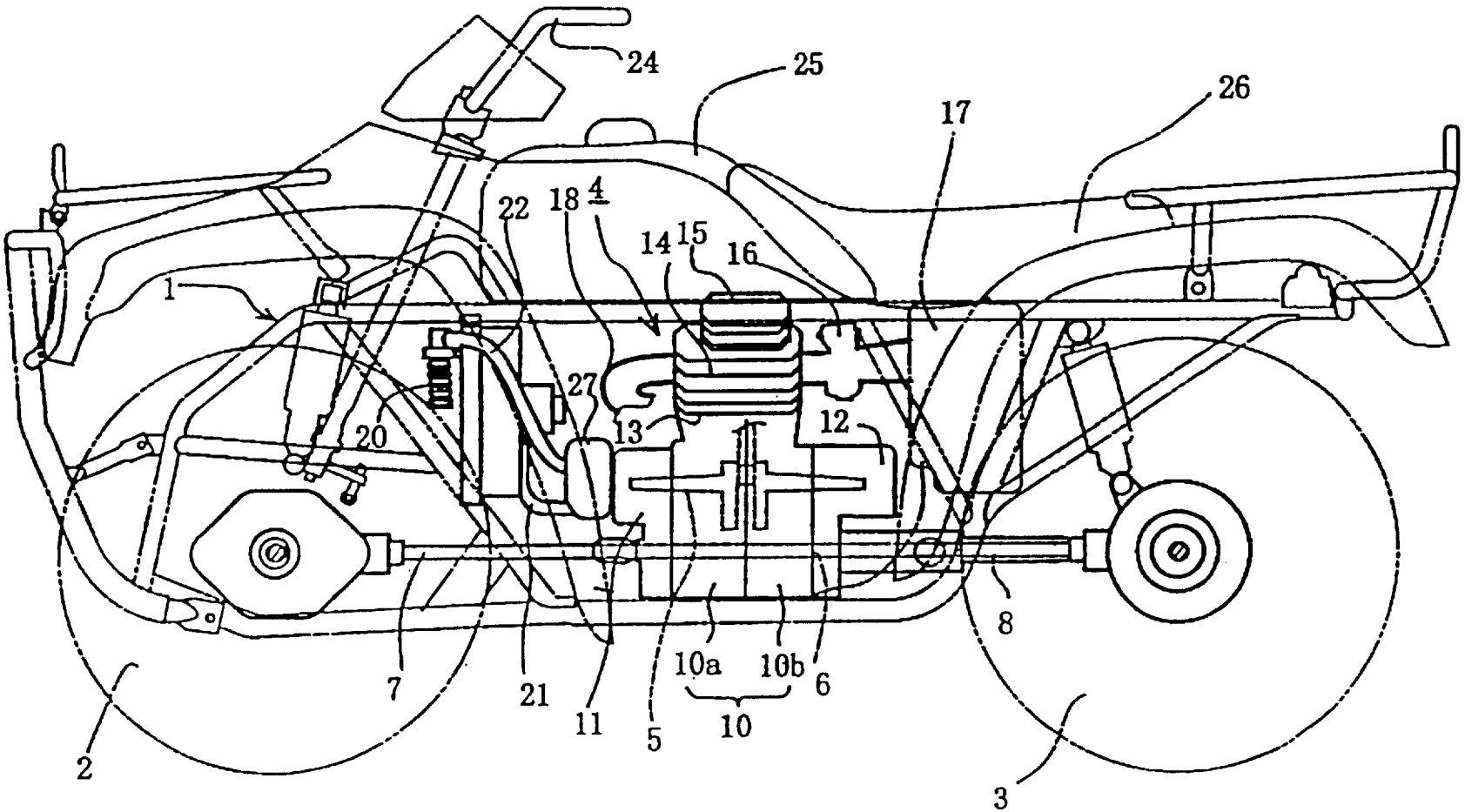
FIG. 2 is a side view of a four-wheeled, all-terian vehicle (ATV) which includes the power unit of FIG. 1.

First, the overall structure of the four-wheeled buggy or ATV will be described with reference to FIG. 2. The four-wheeled buggy is equipped with a pair of front wheels 2 and a pair of rear wheels 3 arranged at the front and rear of a vehicle frame 1, respectively. A power unit 4 includes an integral formation of an engine and a transmission. The power unit 4 is provided at a central part of the vehicle frame 1. The power unit 4 is transverse, with a crankshaft 5 arranged in a direction from the front to the rear of the vehicle.

The four-wheeled buggy is four-wheel drive. The front wheels 2 are driven by an output shaft 6, provided parallel with the crankshaft 5 at the lower part of the power unit 4, via a front wheel propeller shaft 7. The rear wheels 3 are driven by the output shaft 6 via a rear wheel propeller shaft 8.

A front side of a crankcase 10, housing the power unit 4, is covered by a front case cover 11, and a rear side of the crankcase 10 is covered by a rear crankcase cover 12, so as to form a power unit case. The crankcase 10 is partitioned between the front and rear into a front case 10*a* and a rear case 10*b*. A cylinder block 13, cylinder head 14 and cylinder head cover 15 are attached to an upper part of the crankcase 10. A carbureter 16 is connected to an inlet port of the cylinder head 14. An air cleaner 17 is connected from the rear to the carbureter 16. An exhaust pipe 18 is connected to an exhaust outlet of the cylinder head 14.

An oil cooler 20 is located to the front of the power unit 4. The oil cooler 20 communicates with an oil pump provided at the crankcase 10 via a send-side hose 21 and communicates with an oil pump provided within the crankcase 10 via a return-side hose 22. FIG. 2 also illustrates a cooling fan 23, a handle 24, a fuel tank 25, and a saddle-type seat 26. An oil tank 27 is directly mounted to the front surface of the front case cover 11. The oil tank 27 is connected to the oil cooler 20 via the is connected to the oil cooler 20 via the send-side hose 21 and the return-side hose 22. The oil tank 27 is also connected to an oil pump built into the power unit 4.

The crankshaft 5 is supported by main bearings 37*a* and 37*b* at journals 36*a* and 36*b* integrally formed with the front case 10*a* and the rear case 10*b*. A hydro-static infinitely variable transmission 40 is built into the crankcase 10, comprising the engine section of the power unit 4. Approximately one-half of the hydrostatic infinitely variable transmission 40, in the longitudinal direction, overlaps between the main bearings 37*a* and 37*b*.

The hydro-static infinitely variable transmission 40 includes a hydraulic pump 42 and a hydraulic motor 44. The hydraulic pump 42 is driven by a primary driven gear 41 engaging with the primary drive gear 34. The hydraulic motor 44 provides a gear-shifting output to the drive shaft 43. The drive shaft 43 is provided in a direction from the front to the rear of the vehicle, parallel with the crankshaft 5, so that its axis coincides with that of the crankshaft 5.

The drive shaft 43 includes a first oilway 45 that penetrates the axial center of the drive shaft 43. The primary drive gear 34 and the hydro-static infinitely variable transmission 40 constitute a primary reduction means. One end of the drive shaft 43 is directly connected by spline coupling to a main shaft 47 of a stepped transmission 46.

A first speed drive gear 48 and a second speed drive gear 49 are integrally provided at the main shaft 47. These gears engage with a first speed driven gear 51 and a second speed driven gear 52 rotating on a counter shaft 50, parallel with the main shaft 47.

A reverse driven gear 53 is also provided in a freely rotating manner on the counter shaft 50. The reverse driven gear 53 is rotated in an opposite direction to the first speed driven gear 51 and the second speed driven gear 52 by an engagement of a reverse idle gear, provided on a separate shaft, and engaging with the first speed drive gear 48.

Figure 1:
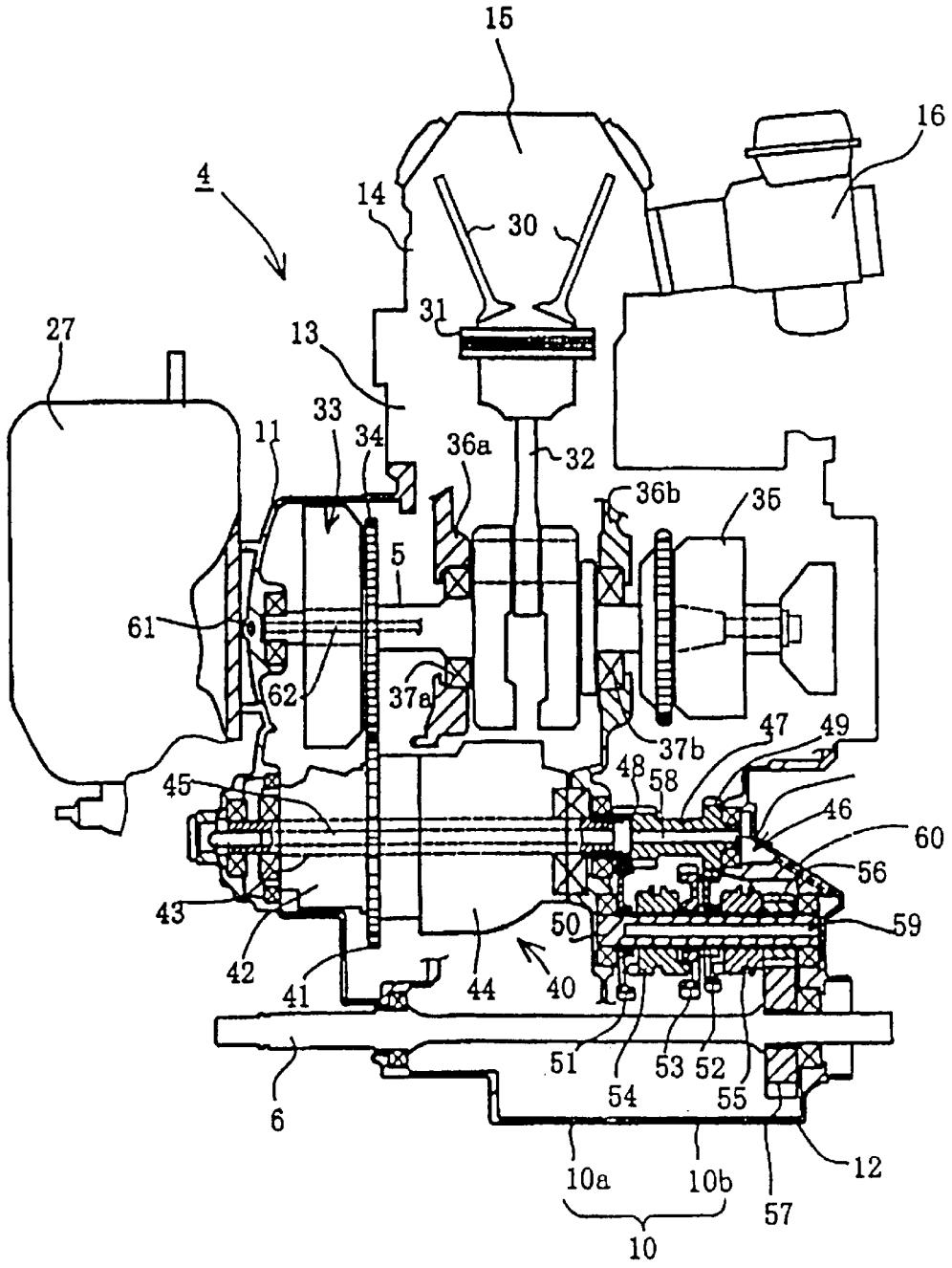
FIG. 1 is a cross-sectional view of an internal combustion engine power unit, taken along a plane including a crankshaft and a drive shaft of a hydro-static infinitely variable transmission.

Shifters 54 and 55 are spline-coupled to the counter shaft 50 in such a manner as to be movable in an axial direction. When the shifter 54 is moved to the left in FIG. 1, rotation of the first speed driven gear 51 is transmitted from an end of the counter shaft 50 to a final drive gear 56, integrally formed with the counter shaft 50. This rotation is then transmitted to an output shaft 6, via a final driven gear 57 on the output shaft 6 engaging with the final drive gear 56.

When the shifter 55 is moved to the left, rotation of the second speed driven gear 52 is similarly transmitted to the output shaft 6, so as to provide second speed driving. When the shifter 54 is moved to the right, rotation of the reverse driven gear 53 is transmitted to the counter shaft 50, so that the counter shaft 50 is rotated in reverse, so as to rotate the output axis in reverse and provide reverse driving. The stepped transmission 46, final drive gear 56 and final driven gear 57 constitute a secondary reduction means.

A second oilway 58 communicates with the first oilway 45 of the drive shaft 43. The second oilway 58 is formed through the axial center of the main shaft 47. A similar, third oilway 59 is formed at the axial center of the counter shaft 50. However, the inner side of the third oilway 59 is closed and an open end on the outer side faces a fourth oilway 60 formed within the wall thickness of the rear crankcase cover 12, so that oil that has passed through the main shaft 47 is supplied.

The ACG 35 and a valve mechanism of the cylinder head 14 are lubricated by a fifth oilway provided in the rear crankcase cover 12 provided separately from the fourth oilway 60. A sixth oilway 62 is also formed at the axial center of the crankshaft 5 so that oil is supplied from a seventh oilway 61 provided at the front case cover 11 and the bearing parts of the starting clutch 33 and the crankshaft 5 are lubricated.

Figure 3:
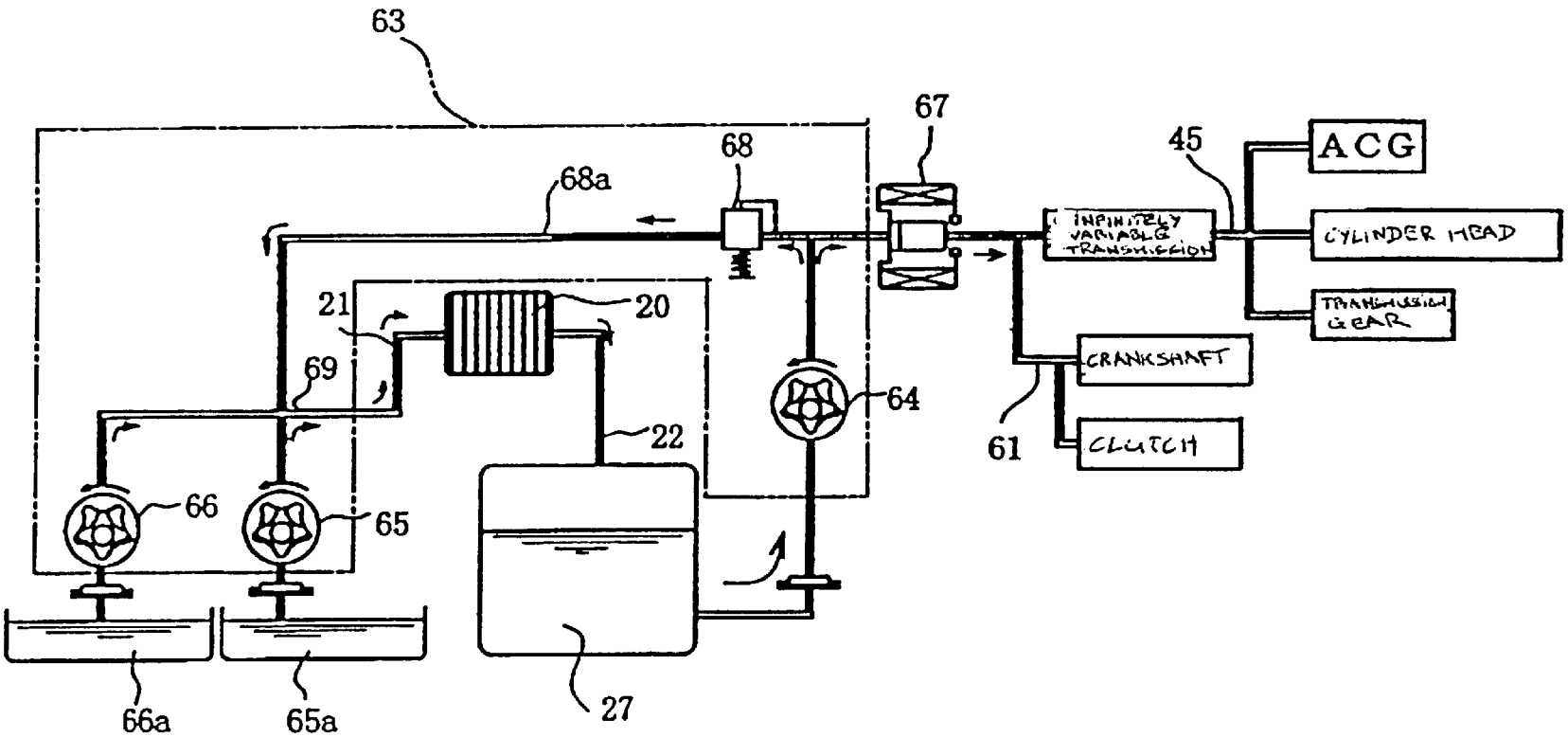
FIG. 3 is a view of an oil system for the power unit.

FIG. 3 shows the oil system, with an oil pump 63 including one feed pump 64 and two scavenging pumps, i.e., a main scavenging pump 65 and a sub-scavenging pump 66.

The feed pump 64 takes in oil from an oil filter 27, discharges oil to an oil filter 67, and supplies oil to the first oilway 45 formed in the drive shaft 43 of the hydro-static infinitely variable transmission 40 and the sixth oilway 62 of the crankshaft 5.

Part of the oil supplied to the first oilway 45 functions as drive oil and lubricating oil for the hydro-static infinitely variable transmission 40. With regards to the remaining oil, the first oilway 45 acts as a passage for lubricating other portions or parts of the engine, e.g., lubricating the secondary declerating means of the ACG 35, the valve mechanism of the valves 30 in the cylinder head 14, the stepped transmission 46.

Oil supplied to the seventh oilway 61 lubricates the crankshaft 5 and the starting clutch 33. A discharge passage of the feed pump 64 communicates with a relief passage 68*a* via a relief valve 68 so that excess pressure is relieved via the relief passage 68*a* when discharge pressure exceeds a prescribed value.

The main scavenging pump 65 and the sub-scavenging pump 66 suck up oil collected in mutually separated oil sumps 65*a* and 66*a* constituted by the bottom of the crankcase 10 itself or by an oil pan. Collected oil is discharged to a discharge passage 69, and is then sent from the return-side hose 21 to the oil cooler 20, together with oil from the relief passage 68*a*.

Figure 4:
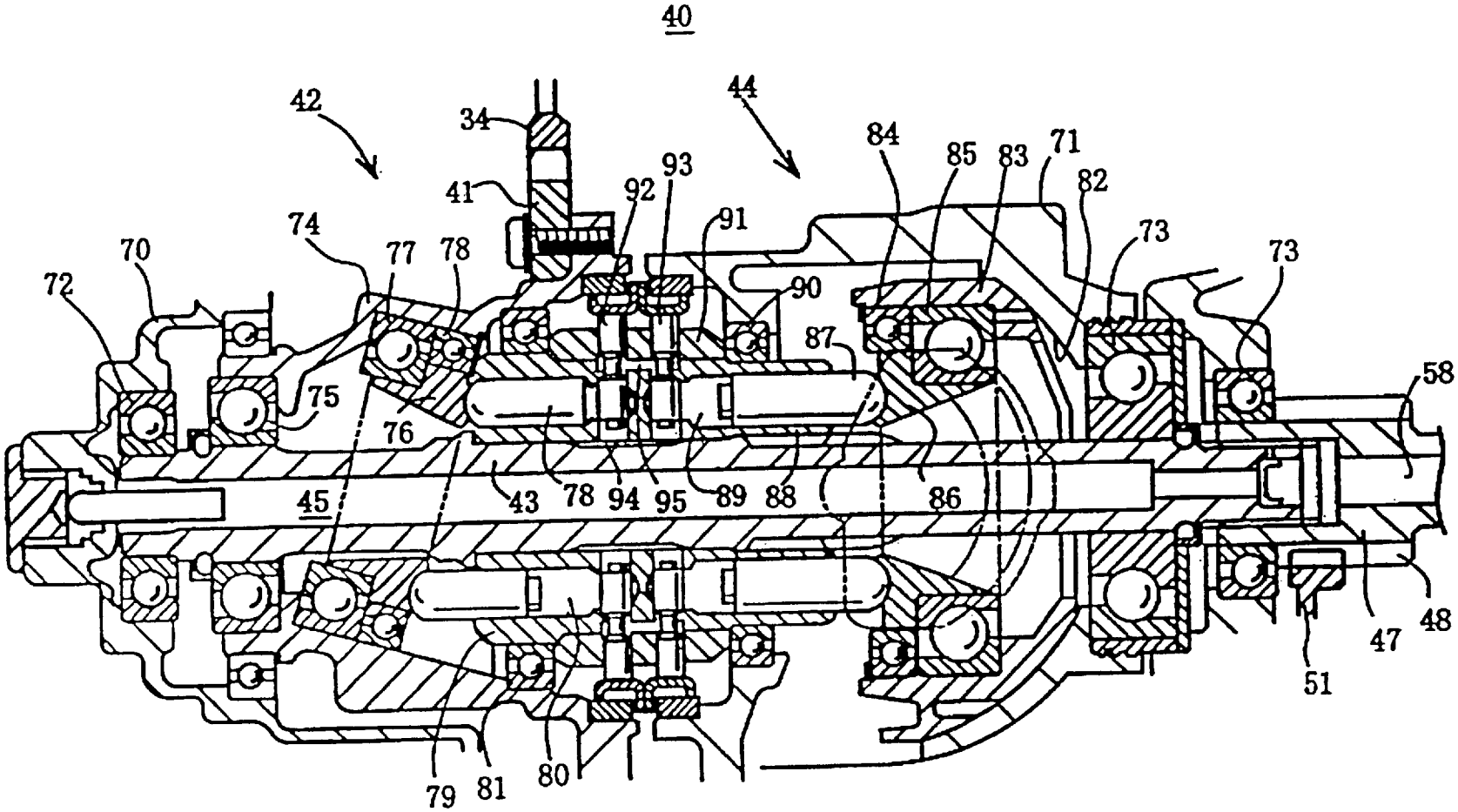
FIG. 4 is a cross-sectional view of the hydro-static infinitely variable transmission.

Next, a description is given of the structure of the hydro-static infinitely variable transmission 40 using FIG. 4. The hydraulic pump 42 constituting part of the hydro-static infinitely variable transmission 40 and each of the housings 70 and 71 of the hydraulic motor 44 are formed integrally as parts of the front case cover 11 and the front case 10*a*, with the ends of the drive shaft 43 being supported in a freely rotatable manner via bearings 72 and 73.

The hydraulic pump 42 is such that an input side rotating section 74 rotating integrally with the primary driven gear 41 is supported in a freely rotating manner at the drive shaft 43 via the bearing 75, inside which a fixed swash plate 76 inclined to the axial direction of the drive shaft 43 is supported in a freely rotating manner via bearings 77 and 78.

A plurality of pump-side plungers 78, the tips of which come into contact with the fixed swash plate 76, move reciprocally with respect to the pump cylinder 79 within pump plunger holes 80 located in an annular manner about the drive shaft 43 so that oil intake and discharge strokes are performed. The outer periphery of the pump cylinder 79 is supported via a bearing 81 so as to be rotatable relative to the input side rotating section 74.

On the other hand, at the hydraulic motor 44, a substantially bowl-shaped swash plate holder 83 is supported in a freely rotatable manner within a concavely curved surface section 82 formed at the housing 71 and a moveable swash plate 86 is freely supported via bearings 84 and 85 at this concavely curved surface.

At the surface of the variable swash plate 86, the same number of motor side plungers 87 as pump side plungers 78 also move reciprocally within motor plunger holes 89 arrayed annularly about the axis of a motor cylinder 88 provided on the axis of the drive shaft 43 so that an extrusion stroke and a back stroke are carried out.

The motor side plungers 87 are made to project due to the pressure of oil discharged by the pump side plungers 78 and press against the surface of the variable swash plate 86. As a result, the motor cylinder 88 is caused to rotate, and an input from the primary driven gear 41 is provided as a gear change output to the drive shaft 43 due to the inner surface of the motor cylinder 88 being spline coupled with the outer periphery of the drive shaft 43.

The transmission gear ratio can be adjusted by changing the inclination of the movable swash plate 86, which can be freely changed by rotating the swash plate holder 83. The outer periphary of the motor cylinder 88 is supported in a freely rotatable manner at the housing 71 via a bearing 90.

The pump cylinders 79 and the motor cylinders 88 are formed integrally at a central large diameter section 91 with pump side valves 92 advancing in the direction of emission and motor side valves 93 being lined up annuarly in two rows and are provided in the same number as the pump side plungers 78 and the motor side plungers 87.

Each of the pump side valves 92 and the motor side valves 93 open and close communicating sections of inner passages 94 and outer passages 95 formed in concentric circles at the inner side of the large diameter section 91 and communicating sections of pump plunger holes 80 and motor plunger holes 89, i.e., during the intake stroke of the pump side plungers 78, the pump side valves 92 open the passages between the pump plunger holes 80 and the inner passages 94 and close the passages between the outer passages 95, while the discharge stroke is the opposite. Similarly, during the extrusion stoke of the motor side plunger 87, the motor side valves 93 open passages between the motor plunger holes 89 and the outer passages 95 and close passages between the inner passages 94, while the reverse is the case for the back stroke.

Next, the operation of this embodiment is described. With this internal combustion engine power unit 4, the hydro-static infinitely variable transmission 40 is built into the crankcase 10 constituting an engine part. A dedicated case for the hydro-static infinitely variable transmission 40, formerly provided separately from the engine, can therefore be omitted for the hydro-static infinitely variable transmission 40. Therefore, the internal combustion engine power unit can be made more compact.

The drive shaft 43 of the hydro-static infinitely variable transmission 40 is parallel with the crankshaft 5, and partially overlaps with the main bearings 37*a* and 37*b* that bear the crankshaft 5. Therefore, the overall length of the engine can be made shorter, in the direction of the crankshaft 5.

The first oilway 45 of the drive shaft 43 is also no longer simply dedicated to the hydro-static infinitely variable transmission 40, but rather is an oilway utilized for lubricating parts of the engine, such as the ACG 35, the cylinder head 14, and the stepped transmission 46. The piping structure can therefore be simplified, and the internal combustion engine power unit 4 can be made more compact.

Further, drive oil for the hydro-static infinitely variable transmission 40 and engine oil for lubricating each of the parts of the engine are used in common. It is therefore not necessary to provide separate oil supply structures, and the structure can therefore be made simpler and more compact. It is also no longer necessary to manage a number of oils and oil management is simplified.

The present invention is by no means limited to the aforementioned embodiment and various modifications are possible. For example, the drive oil of the hydro-static infinitely variable transmission 40 can be used to lubricate parts of the engine, or transmission oil may also be used. Further, rather than using the first oilway 45 to lubricate parts of the engine, oil for lubricating parts of the engine can be supplied by a separate path.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A power unit comprising:

an integral power unit casing;

an internal combustion engine within said power unit casing;

a transmission portion within said power unit casing, wherein oil is utilized in common between said internal combustion engine and said transmission portion; and a hydrostatic infinitely variable transmission residing in said transmission portion of said power unit casing, wherein said hydrostatic infinitely variable transmission includes a drive shaft having a hollow core passing through an axial center of said drive shaft which serves as a first oilway, such that one part of the oil supplied to said first oilway functions as drive oil for said hydrostatic infinitely variable transmission and another part of the oil supplied to said first oilway functions to lubricate parts of said internal combustion engine.

2. The power unit according to claim 1, wherein said hydrostatic infinitely variable transmission further includes a counter shaft, and said counter shaft includes a hollow core passing through an axial center of said counter shaft which serves as a second oilway.

3. The power unit according to claim 2, wherein said internal combustion engine includes a crankshaft, and said crankshaft includes a hollow core passing through an axial center of said crankshaft which serves as a third oilway.

4. The power unit according to claim 1, wherein said internal combustion engine includes a crankshaft, and said crankshaft serves as a second oilway.

5. The power unit according to claim 4, wherein said crankshaft includes a hollow core passing through an axial center of said crankshaft which serves as said second oilway.

6. A power unit comprising:

an internal combustion engine;

a hydrostatic infinitely variable transmission, wherein oil is utilized in common between said internal combustion engine and said hydrostatic infinitely variable transmission, wherein said hydrostatic infinitely variable transmission includes a drive shaft having a hollow core passing through an axial center of said drive shaft which serves as a first oilway; and an oil filter, wherein the oil utilized by both said internal combustion engine and said hydrostatic infinitely variable transmission passes through said oil filter, and wherein one part of the oil supplied to said first oilway functions as drive oil for said hydrostatic infinitely variable transmission and another part of the oil supplied to said first oilway functions to lubricate parts of said internal combustion engine.

7. The power unit according to claim 6, wherein said hydrostatic infinitely variable transmission further includes a counter shaft, and said counter shaft includes a hollow core passing through an axial center of said counter shaft which serves as a second oilway.

8. The power unit according to claim 7, wherein said internal combustion engine includes a crankshaft, and said crankshaft includes a hollow core passing through an axial center of said crankshaft which serves as a third oilway.

9. The power unit according to claim 8, further comprising:

an integral casing for housing said internal combustion engine and said hydrostatic infinitely variable transmission.

10. The power unit according to claim 9, wherein said integral casing is partitioned into a first case and a second case, which mates with said first case.

11. The power unit according to claim 6, wherein said internal combustion engine includes a crankshaft, and said crankshaft serves as a second oilway.

12. The poser unit according to claim 11, wherein said crankshaft includes a hollow core passing through an axial center of said crankshaft which serves as said second oilway.

* * * * *